US006193361B1

(12) United States Patent
Wen

(10) Patent No.: US 6,193,361 B1
(45) Date of Patent: Feb. 27, 2001

(54) APPARATUS FOR FORMING TEXTURED LAYERS OVER IMAGES

(75) Inventor: Xin Wen, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/325,078

(22) Filed: Jun. 3, 1999

(51) Int. Cl.[7] ..... B41J 2/17
(52) U.S. Cl. ..... 347/84; 347/96
(58) Field of Search ..... 347/101, 104, 347/107, 21, 95, 212, 84, 96, 100

(56) References Cited

U.S. PATENT DOCUMENTS 3,946,398 3/1976 Kyser et al. .
4,723,129 2/1988 Endo et al. .
5,260,009 * 11/1993 Penn ..... 264/40.1
5,312,654 * 5/1994 Arimatsu et al. ..... 347/95
5,627,578 * 5/1997 Weintraub ..... 347/107
5,656,378 * 8/1997 Lambert ..... 347/105
6,013,123 * 1/2000 Scarpetti ..... 347/100
6,045,219 * 4/2000 Erdtmann et al. ..... 347/101

FOREIGN PATENT DOCUMENTS 0827833 3/1998 (EP) .
98/08687 3/1998 (WO) .

* cited by examiner

*Primary Examiner*—Eugene Eickholt
(74) *Attorney, Agent, or Firm*—Raymond L. Owens

(57) ABSTRACT

Apparatus for forming a layer having a surface texture in response to a surface texture signal includes a fluid ejection head adapted to deliver polymer fluid. The apparatus positions a receiver relative to the fluid ejection head and such receiver having a preformed image, and causes the fluid ejection head to deliver polymer fluid over the image in accordance with the surface texture signal so that a solid polymer layer having a desired surface texture is formed over the image.

3 Claims, 3 Drawing Sheets

APPARATUS FOR FORMING TEXTURED LAYERS OVER IMAGES

CROSS REFERENCE TO RELATED APPLICATION

Reference is made to commonly assigned U.S. Patent Application Ser. No. 09/325,077, filed concurrently herewith, entitled "Forming Ink Images Having Protection Films" by Xin Wen, the disclosure of which is incorporated herein by reference.

FIELD OF THE INVENTION

The present invention relates to the formation of textured layers over images.

BACKGROUND OF THE INVENTION

Ink jet printing has become a prominent contender in the digital output arena because of its non-impact, low-noise characteristics, and its compatibility with plain paper. Ink jet printing avoids the complications of toner transfers and fixing as in electrophotography, and the pressure contact at the printing interface as in thermal resistive printing technologies. Ink jet printing mechanisms include continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129, issued to Endo et al, discloses an electrothermal drop-on-demand ink jet printer which applies a power pulse to an electrothermal heater which is in thermal contact with water based ink in a nozzle. The heat from the electrothermal heater produces vapor bubble in the ink, which causes an ink drop to be ejected from a small aperture along the edge of the heater substrate. This technology is known as Bubblejet™ (trademark of Canon K.K. of Japan).

Recently, the ink jet printing technologies have advanced significantly so that the ink jet printers can provide images that are close to the silver halide photographic prints. One key requirement for photographs is the surface texture properties. The silver halide photographs have two common types of surface textures: glossy surface and matte surface. Different users tend to have their personal preferences in the type of the surface texture. Gloss refers to the luster and brightness associated with the surface, which is appealing to some users. A gloss surface is usually produced by a smooth surface. One property or shortcoming of the gloss surface is that the viewing of an image is dependent on the illumination and the viewing angles. This is why some users prefer a matte surface that is less dependent on illumination and view directions. A matte surface is often provided by some surface textures, for example, a rough or granular surface, that can scatter light in different directions. The scattering of light decreases gloss and can keep the viewing of an image more or less constant under various observation directions. Sometimes, a mildly matte surface is also called a satin surface. There is a need to conveniently provide ink images with both glossy and matte textures so that the ink images can mimic silver halide photographs.

SUMMARY OF THE INVENTION

It is therefore the object of the present invention to provide for different surface textures over images.

Another object of this invention is to provide ink images with variable surface textures using an ink jet apparatus.

A further object of this invention is to provide variable gloss levels for different areas of an image.

These objects are achieved by apparatus for forming a layer having a surface texture in response to a surface texture signal, comprising:

a) a fluid ejection head adapted to deliver polymer fluid;

b) means for positioning a receiver relative to the fluid ejection head and such receiver having a preformed image; and c) means for causing the fluid ejection head to deliver polymer fluid over the image in accordance with the surface texture signal so that a solid polymer layer having a desired surface texture is formed over the image.

A feature of the present invention is that a textured surface can be produced on an image such as an ink image so that the glossiness of the image can be varied from glossy to matte texture according to user preference.

Another feature of the present invention is that the texture surface is produced by ejecting polymer fluid using a fluid ejection print head and the subsequent polymerization of the polymer fluid on the ink image.

A further feature of the present invention is that a surface texture digital signal defines a frame for an image and the frame has a different surface texture from the surface texture of the adjacent areas over the image.

An advantage of the present invention is that a matte surface texture can be produced on a glossy ink receiver after the ink image is produced so that a user can choose either glossy or matte texture according to user preference.

Another advantage of the present invention is that the textured surface can be varied so that ink images mimic surface textures of silver halide photographic prints without changing the receiver stock.

Yet another advantage of the present invention is that the surface topology of the matte surface can be controlled fluid drive electronics according to an input surface topology digital image so that according to user preference. Different topologies can be produced for different applications.

DETAILED DESCRIPTION OF THE INVENTION

The present invention relates to the formation of textured layers over images. Preferably, the images are formed by ink jet printing.

Figure 1:
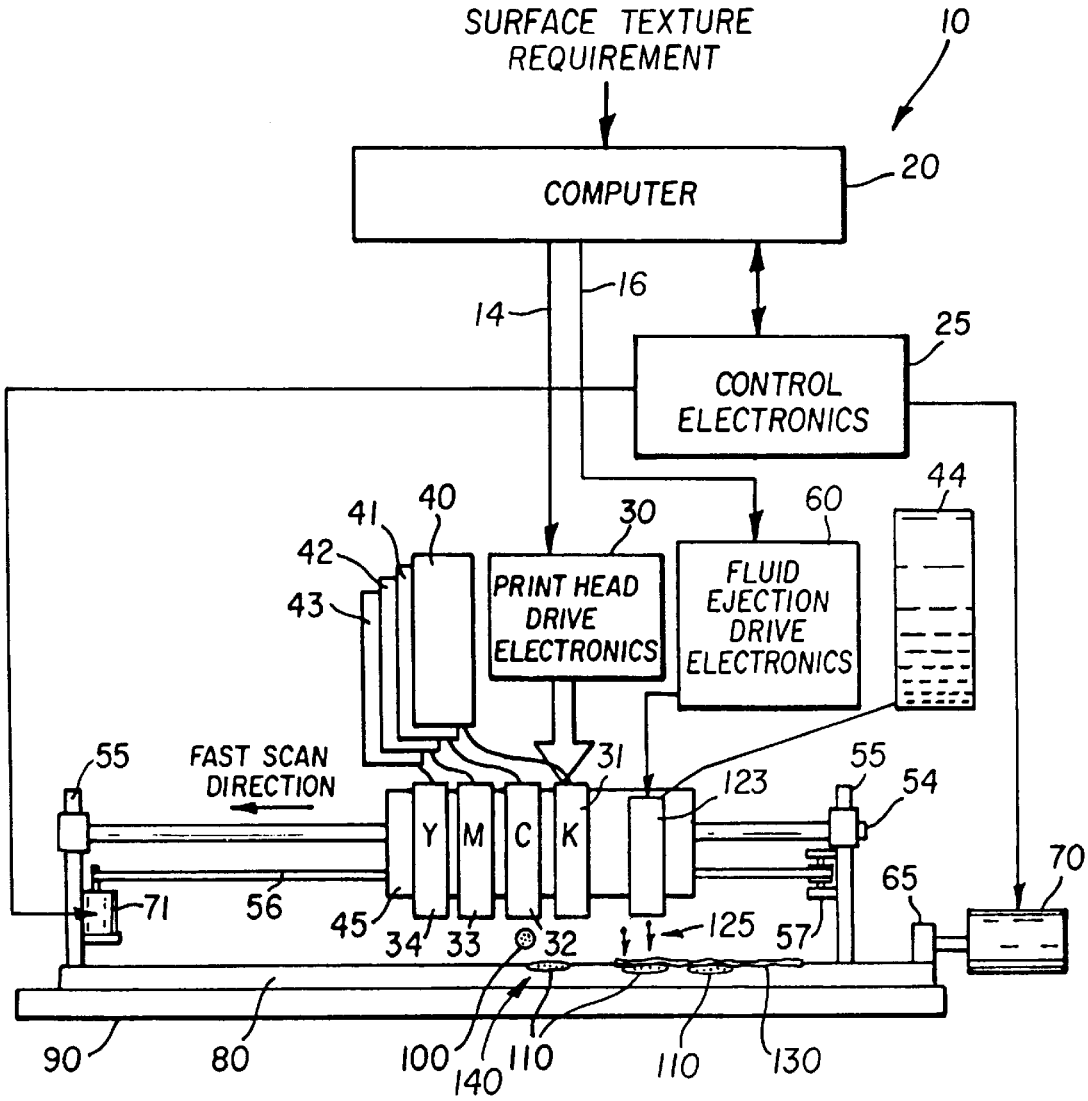
FIG. 1 is a schematic of an ink jet printing apparatus in accordance with the present invention.
Figure 3:
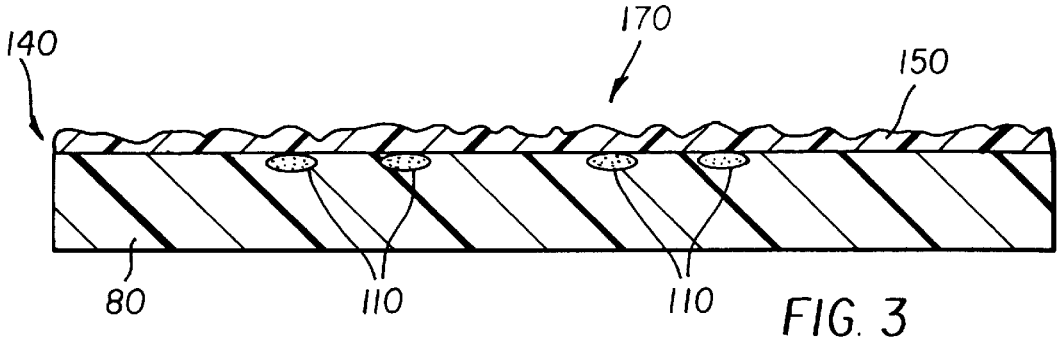
FIG. 3 is a cross-sectional view of a receiver having an ink image and a transparent solid polymer protection film formed by the apparatus in FIG. 1.
Figure 4:
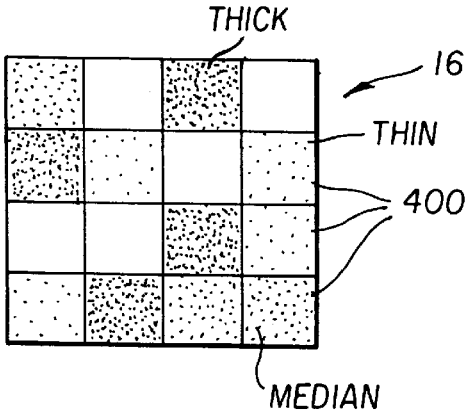
FIG. 4 illustrates the information about the surface texture corresponding to different image pixels in a surface texture digital signal in FIG. 1.

Referring to FIG. 1, an ink jet printing apparatus 10 is shown to comprise a computer 20, control electronics 25, print head drive electronics 30, ink jet print heads 31–34 for printing black ink (K), cyan ink (C), magenta ink (M), and yellow ink (Y), and a plurality of ink reservoirs 40–43 for providing respective colored inks to the print heads 31–34. A digital image to be printed can be either input or produced by the computer 20. Surface texture requirements are input by a user to the computer 20. As described below, the computer 20 sends a digital image 14 to the print head drive electronics 30. The digital image 14 defines the ink image 140 to be formed on the receiver 80. According to the surface texture requirements, the computer 20 produces surface texture digital signal 16 that defines the properties of the surface texture on the polymer layer 150 to be formed over the ink image 140 (FIG. 3). The surface texture digital signal 16 includes information which indicates the desired surface texture of a layer to be formed. Specifically, the surface texture signal 16 can be an image file which specific surface texture of a polymer layer corresponding to different pixels (FIG. 4).

In the present application, the term surface texture refers to the height deviations of a surface from a flat smooth surface. Surface texture can be described by average roughness which characterizes the irregularities of surface texture. The surface texture profile can be measured by digital profiling instruments with computerized analysis techniques. One example of such instruments is a stylus profiler, Dektak 3ST, available from Veeco Instruments Inc., Watford, Herts, U.K.

The print heads 31–34 are fixed to a holder 45 which can be translated by a print head translation motor 71 along the gliding rail 54 in the fast scan direction (as indicated in FIG. 1 by the arrow). The gliding rail is supported by supports 55. The print heads 31–34, the fluid ejection head 123, and the holder 45 are transported by several mechanisms, shown in FIG. 1. More specifically, there is shown a belt 56, a pulley mechanism 57, and the print head translation motor 71. The print head translation motor 71 can be a stepping motor or a DC motor with a servo system.

The ink jet printing apparatus 10 also includes a receiver transport motor 70, an ink receiver 80, and a platen 90. The receiver 80 is supported by the platen 90. The receiver transport motor 70 provides relative movement between the receiver 80 and the ink jet print heads 31–34 with a roller 65 that moves the receiver 80 in a slow-scan direction that is orthogonal to the fast scan direction. It will be appreciated that both the receiver transport motor 70 and the print head translation motor 71 are bi-directional so that the print heads 31–34, the fluid ejection head 123, and the receiver 80 can be transported back to the starting position.

Figure 5:
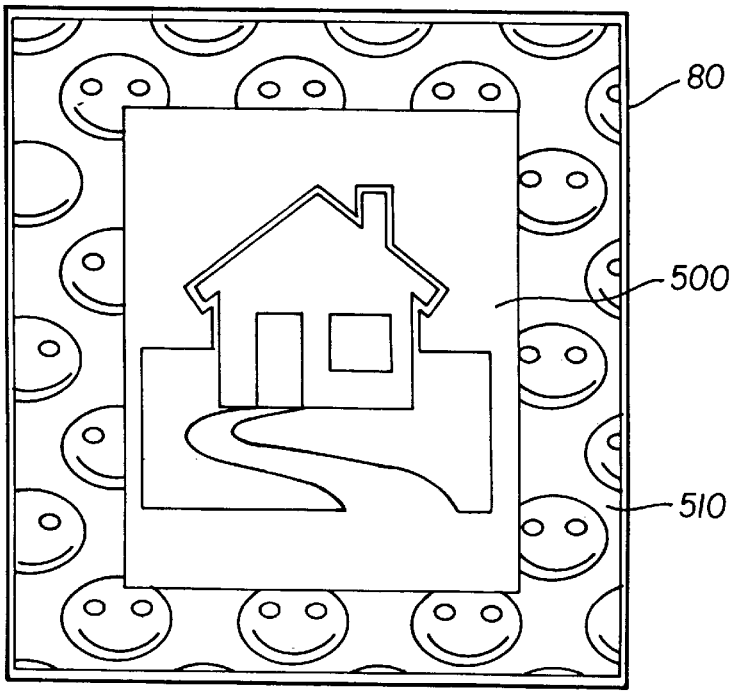
FIG. 5 shows an embodiment of the present invention where an image is surrounded by a frame of a matte surface using the information set forth in FIG. 4.

The ink jet printing apparatus 10 further includes fluid ejection drive electronics 60 and a fluid ejection head 123, for transferring polymer fluids to an ink image, as described below. The fluid ejection head 123 contains a polymer fluid that is supplied by the fluid reservoir 44. The fluid ejection head 123 is preferably an ink jet print head, either thermal ink jet or piezoelectric, as described in the background of this application. When an ink jet print head is used, the polymer fluid is transferred to the ink image in discrete polymer fluid drops 125, in a similar fashion to ink jet printing. Polymer fluid spots 130 are therefore formed on the ink receiver 80. The computer 20 controls the fluid ejection drive electronics 60 to determine the amount or the location of the polymer fluid applied on the ink receiver 80. The polymer layer 150 can be formed over the whole ink receiver 80 or only over part of the ink image 140 as shown in FIG. 5.

In FIG. 1, the fluid ejection head 123 is held on the holder 45 and can be simultaneously moved by the same transport mechanism as the ink jet print heads 31–34. Alternatively, the fluid ejection head 123 can be mounted on a separate transport mechanism. The fluid ejection head 123 can also include a page-wide array of nozzles so that the relative movement between the fluid ejection head 123 and the receiver 80 is provided by the roller 65 moving the receiver 80 under the actuation of the receiver transport motor 70.

Figure 2:
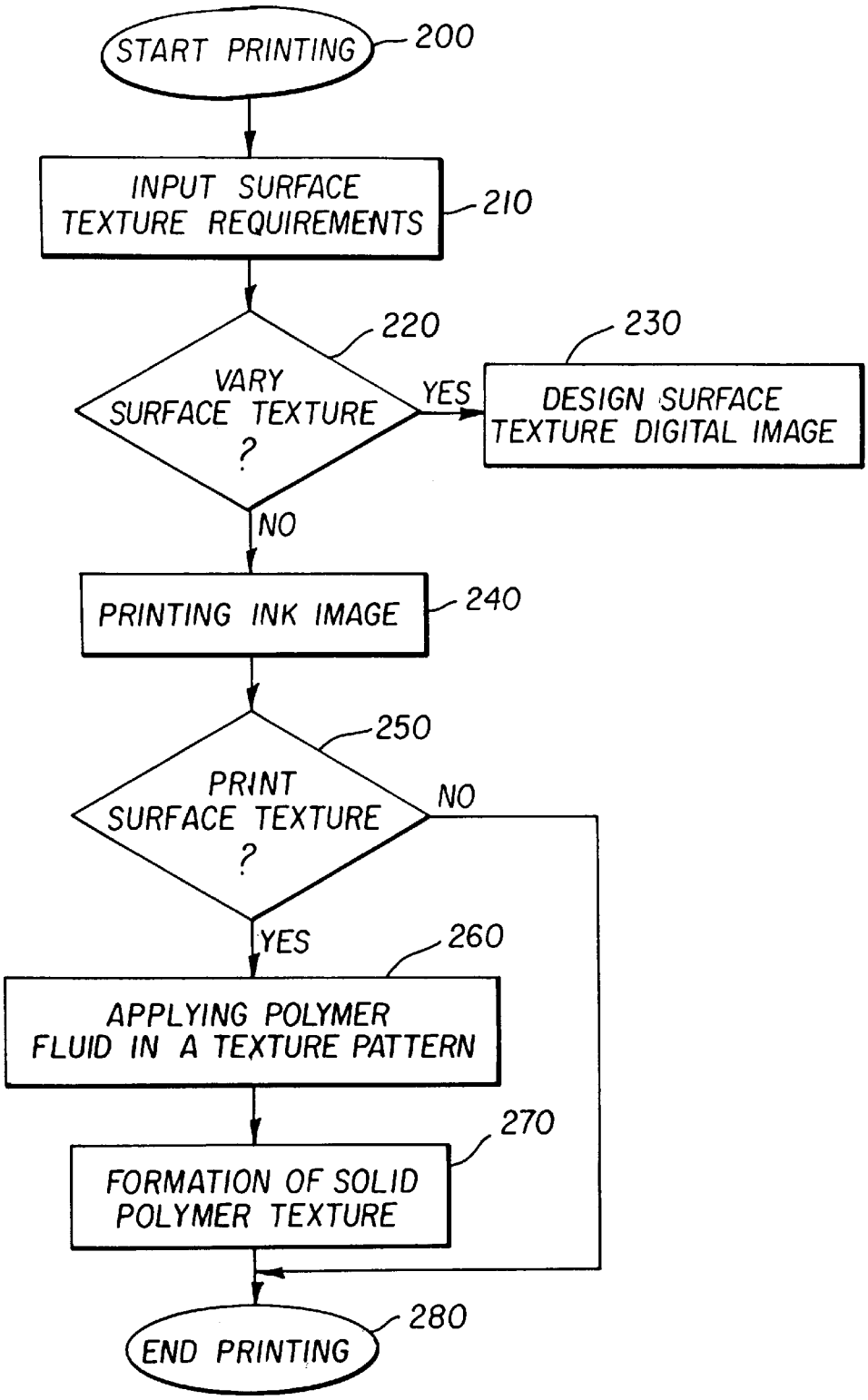
FIG. 2 is a flow diagram of operations of the ink jet printing apparatus in FIG. 1.

The operation of the ink jet printing apparatus 10 is illustrated in FIG. 2. To start the printing operation in box 200, a user inputs surface texture requirements of the image to be formed to the computer 20 as shown in box 210. For example, the user can choose a glossy or a matte surface texture on the ink image. The user may also require a specific degree of gloss that can be produced by a surface texture. FIG. 3 illustrates a finished ink image 170 having desired surface textures(at the end printing in box 280). The ink receiver 80 contains a plurality of ink pixels 110 that form an ink image 140. A solid polymer layer 150 is formed over the ink image 140. The surface texture of the polymer layer 150 is produced according to the surface texture digital signal 16 from the computer 20.

In Box 220, the user is given the choice whether he or she wants to vary the surface texture. If the answer is yes, a surface texture digital signal 16 is designed in box 230. A specific example of such surface texture digital signal is shown in FIG. 4 as a digital image having a plurality of image pixels 400 and surface texture properties therewith. A design pattern of the surface texture is shown in FIG. 5.

In FIG. 4, a surface texture digital signal 16 is shown to be in the form of a digital image having a plurality of image pixels 400. Each image pixel 400 is associated with at least one pixel value (not shown) that describes the amount of polymer fluids to be delivered to that specific pixel for forming desired surface texture properties. In the process of transferring polymer fluids over the ink image 140 (in box 260), these pixel values are sent by the computer 20 to control electronics 25 and in turn to the fluid ejection drive electronics 60. The fluid ejection drive electronics 60 converts the pixel values to the number of and the volume of the polymer fluid drops 125 to be delivered to the corresponding image pixel. After the solidification of the polymer fluid spot 130 in box 270, the thickness or height of the polymer layer 150 is formed at this image pixel 400 that will produce the gloss level required by the user.

In the present invention, the perceived gloss level is correlated with the roughness measured by a profile instrument. The roughness measured by the profile instrument is calibrated to the amount of polymer fluid and the thickness of the solid polymer layer 150 required at each image pixel 400. In FIG. 4, the greater thickness (or height) in the polymer layer 150 is represented by a darkest shade of gray; the median and smaller thickness are respectively represented by lighter shades of gray.

FIG. 5 shows the design of one desired surface texture, made in accordance with the surface texture digital signal 16 as described in relation to FIG. 4. A center image 500 and a frame image 510 are printed on a glossy ink receiver 80 by the ink jet print heads 31–34 using the procedure described in relation to box 250 (see FIG. 2).

It will be understood that the surface texture digital signal 16 can define a different surface texture of the polymer layer 150 for the frame image 510 than the surface texture of the polymer layer 150 for the center image 500. The center image 500 can be an image of user's face or a scene. The frame image 510 can be a decorative border such as a pattern representing picture mask or a theme such as from the Disney movie Jurassic Park. A matte surface texture is then produced over the frame image 510 by forming a polymer layer 150 as described in boxes 260 and 270. The design in FIG, 5 makes the glossy center image 500 stand out in the surrounding of a matte frame image 510, which is pleasing to and desired by many users.

The ink image is next first printed in box 240. A digital image can be input to or produced in the computer 20. The digital image is processed in the computer 20 by image processing algorithms well known in the art, for example, tone scale calibration, color transformation, halftoning, ink rendering etc. An ink receiver 80 is loaded to the ink jet printing apparatus 10 and then moved by the roller 65 under the control of the receiver motor 70.

If the user chooses not to vary the surface texture of the ink image 140 in box 220, the surface type can be selected according to the user's requirement. No polymer fluid needs to be applied. This is the mode of operation in the common ink jet printers currently in the market.

If the user chooses to vary the surface texture of the ink image 140 in box 220, the receiver 80 loaded to the ink jet printing apparatus 10 can be either a glossy or a matte surface. But the ink jet printing apparatus 10 only needs to store ink receivers of one type of surface texture, which is one advantage of the present invention. For example, a glossy ink receiver 80 can be used. The ink image 80 can be made either glossy or matte by applying polymer fluids according to the surface texture digital signal 16, as exemplified in the description in relation to FIG. 5. Alternatively, a matte ink receiver 80 can be used. The glossiness can be increased or decreased at different areas of an ink image as defined by the surface texture digital signal 16. This feature of the present invention reduces the type of ink receivers stocked at the printing site and saves the operator interventions in switching between receivers.

The computer 20 sends signals representing the digital image 14 to the print head drive electronics 30 that prepares electrical signals for the print head 31–34 according to the digital image data. During each printing pass, the computer 20 controls the control electronics 25 to operate the receiver transport motor 70 and the print head translating motor 71. Under the control of the computer 20, the receiver 80 is positioned for image pixels to be formed and then the print head translating motor 71 moves the ink jet print heads 31–34 in a fast scan direction (shown in FIG. 1). The print head drive electronics 30 operates the ink jet print heads 31–34 to deliver ink droplets 100 to the receiver 80 to form ink pixels 10 on the ink receiving surface of receiver 80. Each ink image 140 is usually formed by printing in a plurality of passes.

After the ink image 140 is printed, a question is asked whether surface texture is printed or not in box 250. If no surface texture is to be printed, the printing operation ends in box 280.

If a surface texture is to be printed, in box 260, polymer fluids will be applied over the ink image 140 that has been printed on the ink receiver 80. The computer 20 sends surface texture digital signal 16 to the fluid ejection drive electronics 60 in accordance to surface texture requirements. As described above (FIG. 4), the surface texture digital signal 16 determines the amount the polymer fluid applied to each location on the ink receiver 80. The polymer fluid is transferred to the ink image 140 in discrete polymer fluid drop 125 by the fluid ejection head 123. The polymer fluid drops 125 form polymer fluid spots 130 over the ink image 140 on the ink receiver 80. The time interval between formation of the ink pixels 110 and the ejection of polymer fluid drops 125 is controlled by the computer 20. Preferably, ink pixels 110 is apparently dry on the surface of the ink receiver 80 before the polymer fluid is applied.

Reviewing the operation of the ink jet printing apparatus 10, print head electronics actuates the print head 31–34 for delivering ink to the receiver at different positions for forming ink pixels 110 on the ink receiver 80 to form an ink image 140 in accordance with the digital image 14. The fluid ejection drive electronics 60 actuates the fluid ejection head 123 for applying polymer fluid over the pixels formed by the first ink jet print head so that the polymer fluid forms a solid polymer layer 150 for producing the type of matte surface perception as required by the user in box 210.

The polymeric fluid can be an aqueous solution, polymer dispersion, polymer suspension, or a polymer melt, such as a resin or latex solution. The polymers can include a single type of monomers, or co-polymers of more than one type of monomers. The co-polymerization can be blocked or randomized. As described below, the polymers can form a solid polymer layer 150 when solidified by polymerization. The polymeric fluid can also include colloidal particles such as silica, clays, mica, and polymer particles. The particles are typically in the range of 0.1–3 microns in diameter. The polymeric fluid can also include stabilizers, surfactants, viscosity modifiers, humectants, and other components. These additional components help the polymeric fluids to be effectively ejected out of the nozzles of the fluid ejection head 60, prevent the polymeric fluid from drying at the nozzles, or assist the polymers to properly coalesce over the ink image 140. Examples of the polymer fluids tested in the present invention are described below.

The matte surface perception is produced by the scattering of light by the rough surface features in the polymer layer 150 as shown in FIG. 3. The surface roughness can be produced by controlling the amount of polymer fluid delivered at each image pixel 400 according to the surface texture digital signal 16. The surface roughness and the scattering of light can be enhanced by colloidal particles in the polymer fluid. The colloidal particles can cross-link with the polymers and the ink receiver in the process of forming the polymer layer 150 as described below.

In the present invention, the ink images 140 were printed using thermal ink jet HP 1200 Professional Series Color printer and a piezoelectric ink jet Epson Color Stylus 900 printer. Kodak Inkjet Photo Paper, Epson Glossy Film, Quality Glossy Paper and Photo Paper are used on the Epson Color Stylus 900 printer. Kodak Inkjet Photo Paper, HP Premium Inkjet Glossy Paper, HP Premium Photo Paper and HP Photo Paper are used on the HP 1200 Professional Series Color printer.

An Epson Color Stylus 200 printer is used to apply the polymer fluids over the ink images 140. The polymer fluids are first transferred to the ink cartridges for the piezoelectric print head on the Epson Color Stylus 200 printer. A block of foam material is placed in the cartridge to hold the polymer fluid and dampen the fluid motion during printing. The polymer fluids can include 5% or 10% AQ polymer, or 2% polyvinyl pyridine, or 5% polyurethane in aqueous solution. Glycerol is also added to the polymer fluid as humectant at 5% concentration.

Ink images 140 were printed on receivers 80 using the Epson Color Stylus 900 printer and the HP 1200 Professional Series Color printer. The ink receivers 80 carrying the ink images 140 were fed into the Epson Color Stylus 200 printer. An image file containing the surface texture digital signal 16 was designed on a computer. The image included at least one area with a uniform density. The image file was sent to the Epson Color Stylus 200 printer. The polymer fluids were delivered by the fluid ejection head 123 (that was piezoelectric print head) to form a wet polymer fluid spots 130 over the ink image 140 in accordance to the image file. The location and the amount of the polymer fluid spots 130 were controlled by designing as image in accordance with the surface texture requirements. For example, one or a multiple monolayers of the polymer fluid were overcoated on the ink image 140. Printing resolution (dot per inch), number of fluid ejection drops 123 per pixel, printing speed, drop volume for the delivery of the polymer fluids were also varied.

One advantage of the present invention is that the application of the polymer fluids does not involve the contact of an applicator (such as a contact roller) with the ink image. It has been found that applying polymer fluid in contact with the ink image can disturb the ink image and cause significant loss in image quality.

In box 270, a solid polymer layer 150 is formed by the polymer fluid spots 130. As shown in FIG. 3, the finished ink image 170 has the ink image 140 which includes a plurality of ink pixels 110 and the polymer layer 140 having the desired surface texture. Polymer fluid spots 130 are applied over in box 260 the ink image 140 in accordance with surface texture digital signal 16. The polymer fluid spots 130 are polymerized to form a solid polymer layer 150 over the ink image 140. Strong chemical bonding is formed between the polymer layer 150 and the ink receiver 80. As it is well known in the art, the polymerization can occur through drying in the air, and/or with the assistance of heating or radiation. Preferably, the solid polymer layer 150 is transparent for viewing of the ink image.

The surface texture of the polymer layer 150 was varied by controlling the number and the location of the polymer fluid spots 130 as defined in the surface texture digital signal 16. The resulting surface textures of the polymer layer 150 were quantitatively measured with a surface profiler instrument as described above. Quantitative metrics such as average roughness (Ra) was used to characterize the roughness and for monitoring the intended target set by the surface texture digital signal. Preferably, the height variation of the solid polymer layer 150 (FIG. 3) was in the range between 0 micron (no polymer fluid spot) to 10 microns at each pixel. The polymer layer 150 enhanced the scattering of photons and decreased glossiness of the ink image 140 in controlled fashion.

A gloss surface was also be achieved on a smooth polymer layer 150 by uniformly delivering fluid ejection drops 123 over an area of the ink image 140. An additional benefit of the polymer layer 150 is that it also improves the durability of the ink image 140. Details of the image is described in the above-cited commonly-assigned U.S. patent application Ser. No 09/325,077.

Alternative to the ink images 140 printed by ink jet printing apparatus as described above, the ink image 140 can also be printed by a thermal dye diffusion printer, a laser thermal sublimation printer, a thermal wax printer, electrophotographic printer, and a photographic printer. A polymer layer 150 can be formed over ink images 140 printed by these techniques.

Printing of the ink image 140 and formation of the polymer layer 150 are shown as completed in box 280.

The invention has been described in detail with particular reference to certain preferred embodiments thereof, but it will be understood that variations and modifications can be effected within the spirit and scope of the invention.

PARTS LIST

10 ink jet printing apparatus
14 digital image
16 surface texture digital signal
20 computer
25 control electronics
30 print head drive electronics
31 ink jet print head
32 ink jet print head
33 ink jet print head
34 ink jet print head
40 ink reservoir
41 ink reservoir
42 ink reservoir
43 ink reservoir
44 fluid reservoir
45 holder
54 gliding rail
55 support
56 belt
57 pulley mechanism
60 fluid ejection drive electronics
65 roller
70 receiver transport motor
71 print head translation motor
80 ink receiver
90 platen PARTS LIST (cont'd)

100 ink drop
110 ink pixel
123 fluid ejection head
125 polymer fluid drop
130 polymer fluid spot
140 ink image
150 polymer layer
170 finished ink image
200 start printing
210 input surface texture requirements
220 vary surface texture?
230 design surface texture digital signal
240 printing ink image
250 print surface texture?
260 apply polymer fluid in a texture pattern
270 formation of solid surface texture
280 end printing
400 image pixel
500 center image
510 frame image

What is claimed is:

1. Apparatus for forming a layer over an image, the layer having different surface textures at different locations of the image in response to a surface texture signal, comprising:

a) a fluid ejection head adapted to deliver polymer fluid;

b) means for positioning a receiver relative to the fluid ejection head and such receiver having a preformed image; and c) means for causing the fluid ejection head to deliver different amounts of polymer fluid over the image in accordance with the surface texture signal so that a solid polymer layer having different surface textures at different locations is formed over the image.

2. The apparatus of claim 1 wherein the surface texture digital signal defines a frame for the image and such frame has a different surface texture from the surface texture of the adjacent areas over the image.

3. The apparatus of claim 1 further including at least one ink jet print head for forming an ink image on the receiver.

* * * * *